US005870985A

United States Patent [19]

Bretting

[11] Patent Number: 5,870,985

[45] Date of Patent: Feb. 16, 1999

[54] CUP-SHAPED VALVE TAPPET

[75] Inventor: Werner Bretting, Herzogenaurach, Germany

[73] Assignee: Ina Walzlager Schaeffler OHG, Herzogenaurach, Germany

[21] Appl. No.: 90,530

[22] Filed: Jun. 4, 1998

[30] Foreign Application Priority Data

Jun. 11, 1997 [DE] Germany ..... 197 24 563.3

[51] Int. Cl.[6] ..... F01L 1/24

[52] U.S. Cl. ..... 123/90.55; 123/90.51

[58] Field of Search ..... 123/90.48, 90.49, 123/90.51, 90.52, 90.55; 74/569

[56] References Cited

U.S. PATENT DOCUMENTS

| | | | |
|---|---|---|---|
| 4,876,997 | 10/1989 | Zorn et al. | 123/90.55 |
| 4,951,619 | 8/1990 | Schaeffler | 123/90.55 |
| 5,379,730 | 1/1995 | Schaeffler | 123/90.55 |

FOREIGN PATENT DOCUMENTS

| | | |
|---|---|---|
| 0 485 007 A1 | 5/1992 | European Pat. Off. . |
| 36 23 638 A1 | 1/1988 | Germany . |
| 38 10 436 A1 | 10/1989 | Germany . |
| 40 05 261 A1 | 8/1991 | Germany . |
| 40 30 987 A1 | 4/1992 | Germany . |
| 93 13 919 U1 | 5/1994 | Germany . |
| 43 32 110 A1 | 3/1995 | Germany . |
| WO 90/15226 | 12/1990 | WIPO . |

*Primary Examiner*—Weilun Lo

*Attorney, Agent, or Firm*—Panitch Schwarze Jacobs & Nadel, P.C.

[57] ABSTRACT

A cup-shaped valve tappet (1) for activating a gas exchange valve is provided. The tappet includes a hollow cylinder (2) and a base (3). In the interior of the cup-shaped valve tappet (1), a funnel (6) is situated which has a guide casing (9) for accommodation of a play compensation element (10). The guide casing (9) is overlapped by an internal shell (21) provided with an axial channel (23). In order to prevent an emptying of the annular oil storage space (18) surrounding the guide casing (9) or the inner shell (21), a diverting element (19) is provided which consists of a disk-like section (20) and an outer shell which extends from the disk-like section (20). This outer shell (22) forms a hollow space (25) with the hollow cylinder (2) which is connected to a bore hole (17) and from out of which an overflow opening (26) leads into the annular oil storage space (18).

7 Claims, 2 Drawing Sheets

CUP-SHAPED VALVE TAPPET

BACKGROUND OF THE INVENTION

The invention concerns a cup-shaped valve tappet for activation of a gas exchange valve of an internal combustion engine. The valve tappet includes a hollow cylinder closed on one end by a base with a device for automatic hydraulic valve play compensation which occurs in relation to a cam of a camshaft being arranged in the interior, which basically includes:

- a thin-walled funnel which extends from an internal casing jacket surface of the hollow cylinder toward the base, and ends as a guide casing which is concentric to the hollow cylinder,
- play compensation element arranged in the guide casing,
- a diverting element which lies on an interior side of the base by means of a disk-like section, whereby an inner shell extends from the disk-like section which overlaps with the guide casing while forming an axial channel outside, and whereby the inner casing is surrounded by a ring-shaped oil storage space which can be fed a hydraulic medium through a bore hole provided in the hollow cylinder.

A valve tappet of this type is known from DE 38 10 436. By means of the inner casing which extends from the walls of the funnel bounding the annular oil storage space from below, air reaching into a central oil storage space of the valve play compensation element is supposed to be prevented. This air can be present in the annular oil storage space following a stoppage of the internal combustion engine. Since only the oil from the base area of the funnel reaches into the central oil storage space through the axial channel formed between the inner shell and the guide casing, an in-flow of air can be effectively avoided. In addition, this publication discloses a disk-like element associated with the inner shell which lies on the base of the valve tappet and in this way serves to guide and fix the inner shell. It has been shown that under certain installation conditions of the internal combustion engine, as for example, in relation to vertically tipped cylinder units and extremely obliquely positioned gas exchange valves, the problem that the annular oil storage space can empty during a stoppage of the internal combustion machine can still occur. Following a subsequent starting of the engine, an increased valve play then occurs which is associated with valve operation tapping noises.

Furthermore, providing cup-shaped valve tappets with a diverter in the area of the bore hole which should prevent the annular oil storage space from becoming empty is known. This diverter is constructed together with the funnel and causes an increase in the weight of the cup-shaped valve tappet. Since the funnel must specifically possess a sufficient rigidity for guidance of the valve play compensation element, it is constructed with thicker walls than the diverting element, which serves exclusively for directing the hydraulic fluid or medium. Furthermore, such a one piece construction of the funnel with the outer diverting element is associated with a complicated construction of the funnel and causes a difficult assembly in the cup tappet.

SUMMARY OF THE INVENTION

It is therefore the object of the invention to provident an improved cup tappet which has a simpler way of diverting the hydraulic medium in the entry area into the annular oil storage space with the improvement being possible without any basic increase in weight.

This object is accomplished in accordance with the invention in that an external shell, radially delimiting the annular oil storage space on the outside, extends axially up to the funnel from the disk-like section, and in that the external shell forms a hollow space together with the hollow cylinder into which, first of all, the bore hole opens, and secondly from which an overflow opening leads to the annular oil storage space. Consequently, a component is provided within the cup tappet which undertakes diverting of the hydraulic medium in the bore hole area as well as using suction to draw hydraulic medium from the annular oil storage space into the central oil storage space. This component can be constructed with very thin walls so that the weight of the cup-shaped tappet can be kept very low despite this twofold diverting. The external shell which extends from the disk-like section forms an annular space together with the hollow cylinder so that the hydraulic medium reaching the annular space must first of all flow through the annular space in a peripheral direction in order then to reach the annular oil storage space via the overflow opening. Consequently, the bore hole and the overflow opening must be arranged circumferentially displaced in relation to each other.

In further configuration of the invention, the overflow opening can be constructed in the outer shell. There thus results the simple possibility of producing an appropriate overflow opening in this outer shell by drilling. Furthermore, this overflow opening can be displaced 180° in relation to the bore hole. A labyrinth diverting of the oil current results from this which prevents the annular oil storage space from running empty, with some certainty.

In a further configuration of the invention, the overflow opening should be arranged in an area of the outer shell near the base. As a result of this, the oil stream entering about in the middle of the hollow cylinder through the bore hole is guided in a circumferential as well as in an axial direction. The overflow opening is displaced in relation to the bore hole as well as in relation to the entry into the axial channel, which can provide additional improvement to the previously explained labyrinth diverting system.

The annular space can be manufactured by the hollow cylinder being provided with a collar on its internal jacket surface in an area near the base and, at an axially set distance from this, with an outside roller produced bulge on which the outer shell lies. In this way, an annular space running between collar and bulge is created by simple means, as the outer shell constructed precisely in an axial direction lies in a sealing manner on the bulge and the collar, while the remaining area of the hollow cylinder is at a distance from the outer shell.

A simple mode of fixing the diverting element results from the fact that the outer shell is fixed on the bulge with its flanged edge, whereby the flanged edge is fixed between a flank of the bulge and the appropriate edge of the funnel. During assembly, the diverting element is first inserted in to the cup-shaped valve tappet until the disk-like section lies on the base and the edge of the outer shell lies on the bulge. Then the funnel is pushed into the cup-shaped valve tappet until it lies on the edge of the outer shell. Subsequently, the funnel is welded to the hollow cylinder, or fastened to it in another manner.

Furthermore, it is proposed as an alternative solution for a representatively constructed cup-shaped valve tappet that an outer shell which extends from the disk-like section and delimits the outside of the annular oil storage area, where the shell extends axially up to the funnel, and that the outer shell forms an annular space together with the hollow cylinder in which, for one, the bore hole opens and from which, secondly, a transverse channel arranged between the base and disk-like section, running radially, is guided up to the axial channel. In accordance with this solution, a transverse channel is consequently provided instead of the overflow opening provided according to the first proposed solution. As an alternative to joining this transverse channel with the axial channel, an opening can be provided through which the hydraulic medium can reach the annular oil storage area.

Reference is made to further discussion of the invention in the embodiments below.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. Depicted in the drawings are.

DETAILED DESCRIPTION OF THE INVENTION

Figure 1:
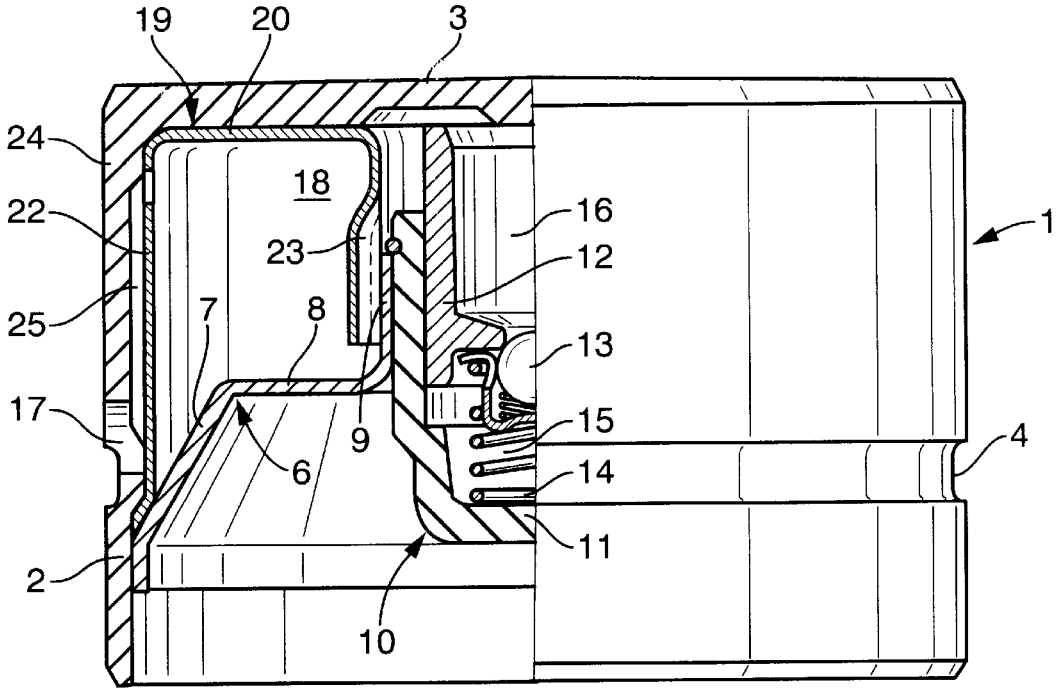
FIG. 1 a half section through a cup-shaped valve tappet in longitudinal section with a valve play compensation element arranged therein.

Certain terminology is used in the description for convenience only and is not limiting. The word "right," "left," "lower" and "upper" designate directions in the drawings to which reference is made. The words "inwardly" and "outwardly" refer to directions toward and away from, respectively, the geometric center of the cup-shaped valve tappet and designated parts thereof. The terminology includes the words specifically mentioned above, derivatives thereof and words of similar import.

A cup-shaped valve tappet 1 is shown in FIGS. 1 to 4, which includes of a hollow cylinder 2 and a base 3 closing the hollow cylinder 2 off on one end. Furthermore, in all of the embodiments represented in FIGS. 1 through 4, the hollow cylinder 2 includes a rolled indent 4 in a middle area which leads to a bulge on an inner casing surface of the hollow cylinder 2. A funnel 6 is positioned in the interior of the cup-shaped valve tappet 1 which extends from the hollow cylinder 2 and initially has a frustrum-shaped wall section 7 to which a level wall section 8 which extends basically parallel to the base 3 is joined. This level wall section 8 of the funnel 6 transitions into a guide casing 9 which runs concentrically to the hollow cylinder 2 and accommodates the actual play compensation element 10 (see FIG. 1).

The play compensation element 10 includes a hollow piston 11 movably installed in a known manner in the guide casing 9, a piston 12, a valve 13 and a spring 14. The hollow piston 11, the piston 12 and the valve enclose a high pressure area 15. This high pressure area 15 is provided with oil from a central oil storage space 16 through the valve 13 for the purpose of compensation for valve play. This oil has previously reached an annular oil storage space 18 through a bore hole 17 which is situated in the area of the rolled indent 4, and in the groove created by this.

Figure 2:
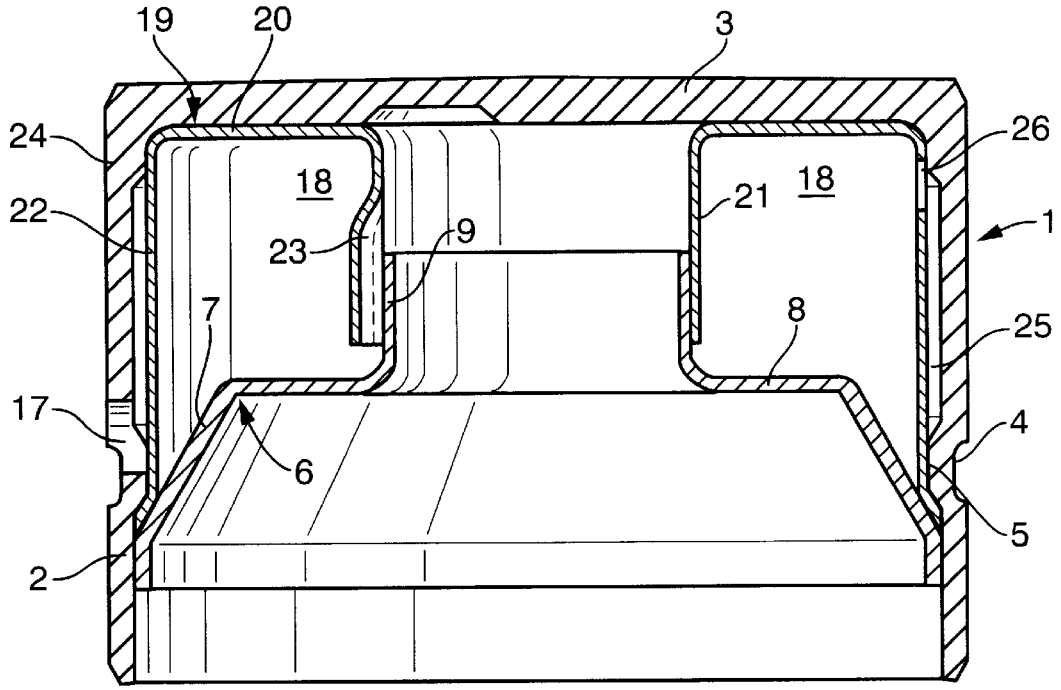
FIG. 2 an enlarged representation of a valve tappet in longitudinal section, in which no play compensation element is installed in this valve tappet for clarity.
Figure 3:
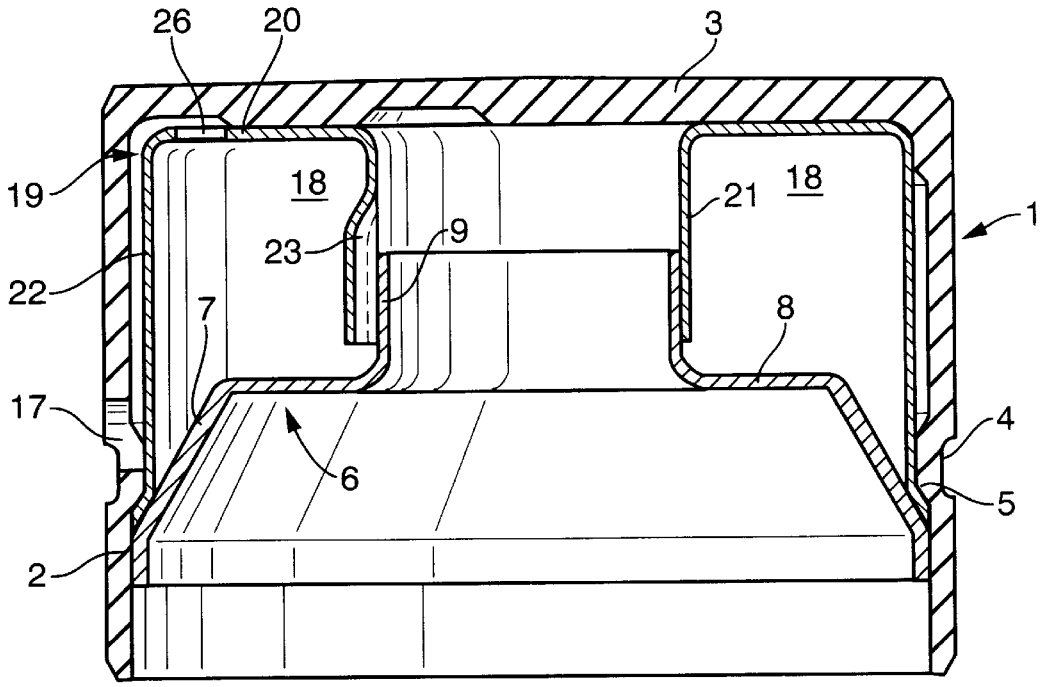
FIG. 3 a further embodiment of a cup-shaped valve tappet without a play compensation element arranged in it, shown in longitudinal section.

The diverting of the oil flow of the invention which begins through the bore hole 17 into the cup-shaped valve tappet 1 up to the central oil storage space 16 is shown in FIGS. 2 and 3. First of all, with reference to FIG. 2, a diverting element 19 is situated in the annular oil storage space 18, and includes a disk-like section 20, an inner shell 21 and an outer shell 22. The inner shell 21 overlaps with the guide casing 9, whereby, due to its formation, it forms a local axial channel 23 with the guide casing 9. The outer shell 22 is for one guided in a sealing manner on the bulge 5, and secondly lies near the base 3 on a collar 24. In this way, an annular space 25 arises between the bulge 5 and the collar 24 bounded by the hollow cylinder 2 and the outer shell 22. This annular space 25 is connected with the bore hole 17 and opens into the ring-like oil storage area 18 through an overflow opening 26. This overflow opening 26 is displaced 180°peripherally in relation to the bore hole 17. In this manner, a labyrinth diversion of the oil arises in a simple way so that the valve tappet 1 can be prevented from running empty with certainty.

Figure 4:
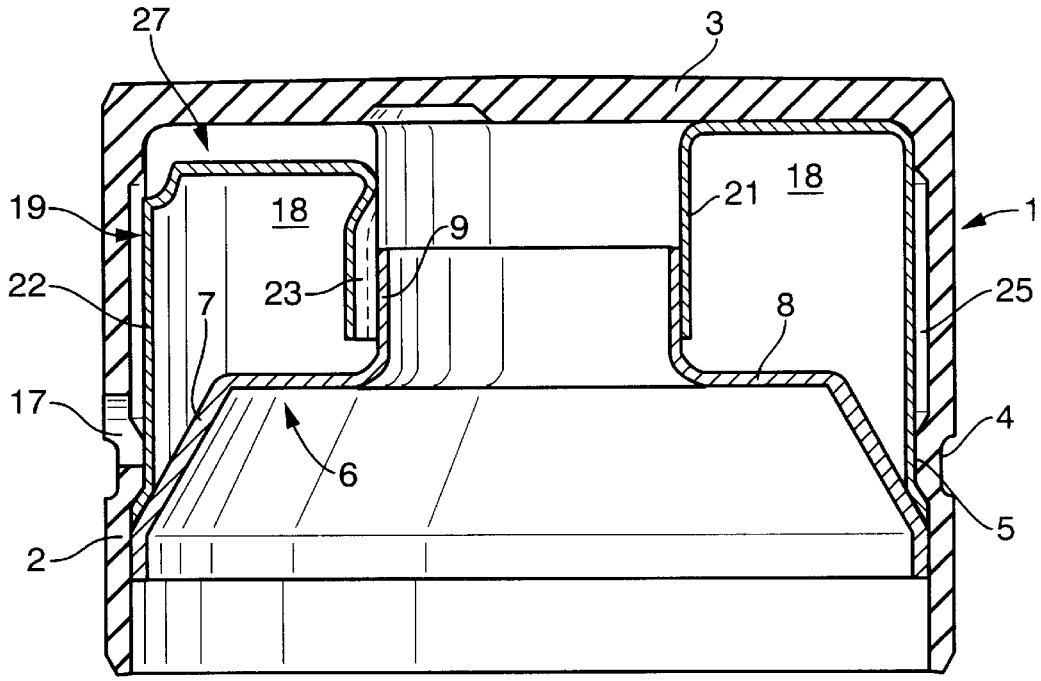
FIG. 4 a further configuration of a cup-shaped valve tappet without a play compensation element arranged therein, shown in longitudinal section.

FIGS. 3 and 4 differ in relation to FIG. 2 only in that in accordance with FIG. 3, the collar 24 is omitted, and the oil reaches the annular oil storage space 18 through an overflow opening 26 situated in the disk-like section 20. According to FIG. 4, the overflow opening 26 is dispensed with, and instead of this, a transverse channel 27 is provided between the disklike section 20 and the base 3, whereby this transverse channel leads directly to the central oil storage space 16.

What is claimed is:

1. A cup-shaped valve tappet (1) for activation of a gas exchange valve of an internal combustion engine, the tappet having a hollow cylinder (2) closed off on one end by a base (3), and a device for automatic hydraulic valve play compensation which occurs in relation to a cam of a camshaft located in the hollow cylinder, comprising:

a funnel (6) which extends from an inner surface of the hollow cylinder (2) in a direction of the base (3) and ends as a guide casing (9) concentric to the hollow cylinder (2), a play compensation element (10) arranged in the guide casing (9), a diverting element (19) which lies on an interior side of the base (3), the diverting element including an inner shell (21) and an outer shell (22) which extend from a disk-like section (20), a substantial portion of the disk-like section (20) being in contact with the base of the tappet, the inner shell (21) being overlapped with the guide casing (9) to form an axial channel (23), the inner shell (21) being surrounded by an annular oil storage space (18) adapted to receive a hydraulic medium through a bore hole (17) located in the hollow cylinder (2), the outer shell (22) bounds the annular oil storage space (18) radially outside and extends axially up to the funnel (6), to form an annular space (25) together with the hollow cylinder (2) into which the bore hole (17) opens, and an overflow opening (26) located in the diverting element leads to the angular oil storage space (18).

2. The cup-shaped valve tappet (1) according to claim 1, wherein the overflow opening (26) is located in the outer shell (22).

3. The cup-shaped valve tappet (1) according to claim 2, wherein the overflow opening (26) is displaced 180 peripherally in relation to the bore hole (17).

4. The cup-shaped valve tappet (1) according to claim 2, wherein the overflow opening (26) is situated in an area of the outer shell (22) near the base (3).

5. The cup-shaped valve tappet (1) according to claim 1, wherein the hollow cylinder (2) is provided with a collar (24) on an internal surface in an area near the base (3) and is provided with bulge (5) produced by an external roller-indentation (4) spaced axially from the collar (24), and the outer shell (22) lies on the collar (24) and the bulge (5).

6. The cup-shaped valve tappet (1) according to claim 5, wherein the outer shell (22) includes a flanged end, and is fixed on the bulge (5) with the flanged edge, whereby the flanged edge is fixed between a flank of the bulge (5) and the funnel (6).

7. The cup-shaped valve tappet (1) according to claim 1, wherein the overflow opening (26) is arranged in the disk-like section (20).

* * * * *